United States Patent [19]

Medal

[11] Patent Number: 4,724,694

[45] Date of Patent: Feb. 16, 1988

[54] METHOD OF MANUFACTURING A THREAD-FORMING SCREW

[75] Inventor: James Medal, Cape Coral, Fla.

[73] Assignee: The Fastron Company, Franklin Park, Ill.

[21] Appl. No.: 900,422

[22] Filed: Aug. 26, 1986

Related U.S. Application Data

[62] Division of Ser. No. 606,765, Jul. 5, 1984, abandoned.

[51] Int. Cl.[4] ..... B21H 3/02; B21K 1/56

[52] U.S. Cl. ..... 72/88; 10/10 R

[58] Field of Search ..... 10/10 R, 27 R, 27 E, 10/140, 141 R, 152 R, 152 T; 72/88, 90; 411/386, 387, 416

[56] References Cited

U.S. PATENT DOCUMENTS

| | | | |
|---|---|---|---|
| 2,309,053 | 1/1943 | Farrell | 10/27 R X |
| 3,104,161 | 9/1963 | Carlson | 10/152 T |
| 3,180,126 | 4/1965 | Carlson | 10/10 R X |
| 3,209,383 | 10/1965 | Carlson | 10/152 T |
| 3,461,470 | 8/1969 | Cochrum | 10/10 R |
| 4,368,552 | 1/1983 | Sugiyama | 10/10 R |
| 4,584,247 | 4/1986 | Mulholland | 10/152 R X |

FOREIGN PATENT DOCUMENTS

| | | | |
|---|---|---|---|
| 716736 | 8/1965 | Canada | 10/10 R |
| 1415688 | 9/1965 | France | 10/10 R |

*Primary Examiner*—E. Michael Combs

*Attorney, Agent, or Firm*—Fitch, Even, Tabin & Flannery

[57] ABSTRACT

A method is disclosed of manufacturing a thread forming screw with a constant diameter helical screw thread and lead-in threads having a plurality of sharp crests and intermediate relief concave areas. The method includes the steps of forcing a cylindrical wire into a die to form on a distal end of the wire a plurality of longitudinally extending ribs spaced from each other by reduced diameter cylindrical portions. The distal end is rolled between tapered thread sections of a die set to taper the distal end and to form the lead-in threads with sharp crested lobes and intermediate relief areas while the constant diameter helical screw thread is also being formed by the die set.

3 Claims, 8 Drawing Figures

METHOD OF MANUFACTURING A THREAD-FORMING SCREW

This is a division of application Ser. No. 606,765, filed July 5, 1984 abandoned.

BACKGROUND OF THE INVENTION

The present invention relates to fasteners and, more particularly, to a thread-forming screw and its method of manufacture.

It is common practice to use a thread-forming screw to form a female screw thread in a work piece. This avoids the extra step of using a tap to form the mating screw thread prior to application of a screw. An advancement in the fastener art was the introduction of a thread-forming screw with the lead in or distal end portion of the shank having trilobular thread turns. The lobes of each turn of this thread work the material of the wall forming the pilot hole, to form a female thread, while arcuate thread sections between the lobes provide regions of relief to reduce the driving torque needed to form the new thread. For a further description of the structure, operation and method of manufacturing this screw, reference may be made to commonly assigned U.S. Pat. No. 3,461,470.

While the trilobular screw works well, it does have areas susceptible to improvement. This screw does not have a fully formed sharp crest on the first few turns of the thread and has been found to have a tendency to tip upon initial threading. The present invention is directed to forming a self-threading screw that has a reduced driving torque than of fasteners such as shown in U.S. Pat. No. 3,461,470. In that patent, the leading end of he wire is cold headed in a die to form a blank having a tapered distal end. The formation of this taper tends to reduce the life of the blank-forming die because the die must reduce a very substantial cross-sectional area of the length of wire and then eject this tapered end from the die forming it.

A number patents disclose the formation of a conical end or tip on a blank which is then formed into a screw thread or further cold worked. For instance, Veldman U.S. Pat. No. 4,235,149 discloses a blank with a frusto-conical section on its distal end which is rolled by special dies to have concave surfaces formed in the tapered lead-in section between spaced lobes. Between the concave surfaces and the protruding lobes are ramp surfaces smoothly blending the lobes and concavities to each other. However, the first few thread turns of the lead-in section are not fully formed and have flats thereon which require greater turning torque than fully formed threads. U.S. Pat. No. 3,218,656 discloses a conical end on a blank, which conical end is extruded, usually in a cold header, to form four symmetrically arranged and spaced, flattened relief areas. Also, in Reiland U.S. Pat. No. 3,218,905 a tapered conical end is first formed on the blank and then flats are formed in the conical end. The formation of such conical ends on a blank may be eliminated with the present invention.

In U.S. Pat. No. 3,195,156, a circular cross-section wire is drawn through a die to form a trilobular shape for the entire screw including the holding portion which reduces its holding torque power. This extra step of reshaping the entire length of the wire blank and then forming a tapered end on the wire blank is eliminated with the present invention.

SUMMARY OF THE INVENTION

Among the several objects of the present invention may be noted the provision of an improved thread forming screw and its method of manufacture; the provision of such screw which starts forming the female thread during the entrance of the first turn of the screw thread into the pilot hole; the provision of a screw having its lead-in threads fully developed and co-axial with the longitudinal axis to alleviate tipping of the screw during initial threading; threaded screw; the provision of such screw which has lower driving torque; and the provision of such screw which has long service life, is easy to install, and is simple and economical to manufacture. Other objects and features of the present invention will be in part apparent and in part pointed out hereinafter in the specification and attendant claims.

Briefly, a method of manufacturing a thread-forming screw includes several steps. One end of the length of wire is forced into a die defining a cavity having first and second coaxial portions. These portions are generally cylindrical except a plurality of ribs extend into the second cavity portion to form grooves in the wire. The remaining end of the wire is forced into a heading die to form a head and the thus formed blank is removed from the die. The blank is rolled between threading dies which move parallel to one another and which are contoured to concurrently form a thread and to taper the distal end of the blank having the grooves. The threading dies function to form a sharp thread crest with the first turn of the thread.

BRIEF DESCRIPTION OF THE DRAWINGS

Corresponding reference characters indicate corresponding components throughout the several views of the drawings.

DESCRIPTION OF THE PREFERRED EMBODIMENT

Figure 6:
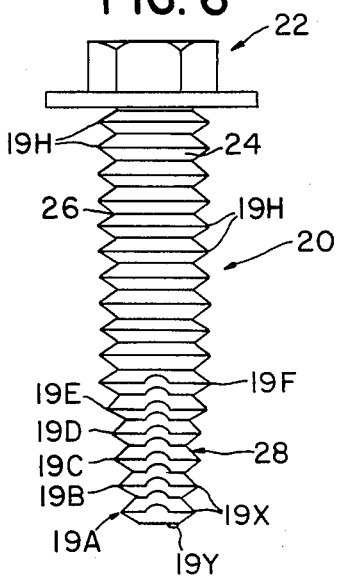
FIG. 6 is a front elevational view of the thread-forming screw of the present invention.
Figure 7:
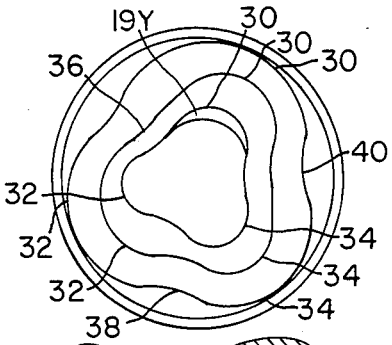
FIG. 7 is an end view of FIG. 6 showing the trilobular thread of the distal screw end.

Referring now to the drawings, a thread-forming screw of the present invention having a thread 19 is best shown in FIG. 6 and is generally indicated by reference character 20. The screw has enlarged head means or head 22 and a cylindrical shank or shaft 24 extending therefrom with a generally cylindrical proximal end 26 and a distal or lead-in end 28. The holding portion of the screw thread provided on end 26 has threads 19H with a substantially constant crest height whereas the screw thread portion on the lead-in end 28 has a variable crest height. As best shown in FIG. 7, each turn of the distal end has a trilobular configuration having equally angularly spaced high points or lobes 30, 32, 34 spaced from each other by arcuate relieved thread portions 36, 38, 40 each of convex shape.

Figure 1:
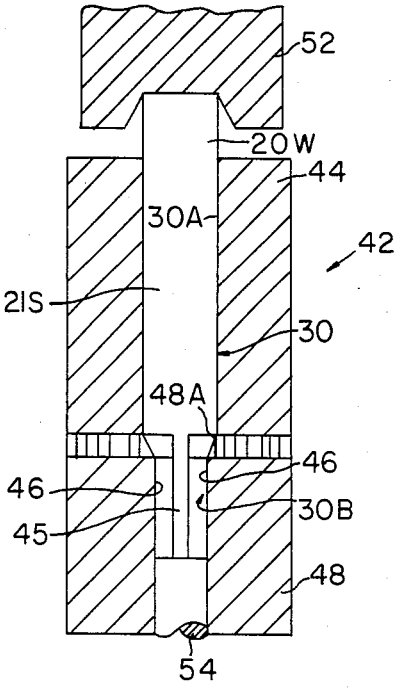
FIG. 1 is a fragmentary sectional view showing a step in the formation of a screw blank in accordance with the method of the present invention.
Figure 2:
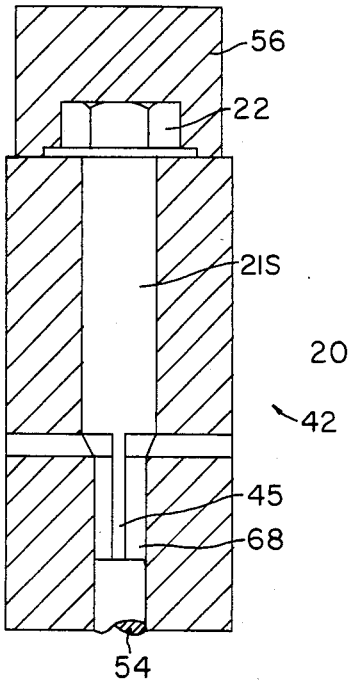
FIG. 2 is a fragmentary sectional view, similar to FIG. 1, showing the formation of a head of the blank.
Figure 3:
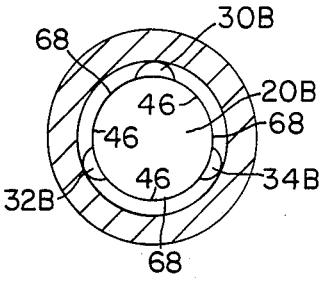
FIG. 3 is a fragmentary sectional view taken generally along line 3—3 of FIG. 2 showing grooves formed on the distal end of the shank of the blank.

The method of forming a blank 20B for the screw is best described with reference to FIGS. 1-3. A die assembly 42 for use in forming a predetermined discrete length of wire 20W into the blank includes die system having a die cavity 30 having first and second coaxial portions. The first or upper portion is a generally cylindrical cavity 30A and is defined by a die insert 44 while a lower second cavity 30B is also generally cylindrical except for a plurality identical equally angularly spaced longitudinal grooves or slots 45 extending radially outwardly from arcuate wall sections 46 between the respective grooves 45 in a lower die insert 48. The die inserts are rigidly held in axial alignment by a shroud which is suitably attached to and forms part of a screw-forming machine of the type well known to those of skill in the art. Also included in that machine is a ram 52 for applying axial force to wire 20W to force the leading end of the wire into the lower die cavity 30B and thus cause the wire to assume the shape of this lower cavity. The lower end of the cavity is closed off by an axially slidable ejector rod 54 which moves upwardly for ejecting the finished blank from the die cavity. As the ram forces the wire into the cavity, metal forming the wire is compelled to cold flow into the slots 45 in the arcuate wall sections 46 of the die, thus forming longitudinally extending protrusions or ribs 30B, 32B, 34B (FIG. 3) projecting radially outwardly at the distal end of the stem of the blank 20B. This cold flowing work hardens the material forming the ribs.

Figure 4:
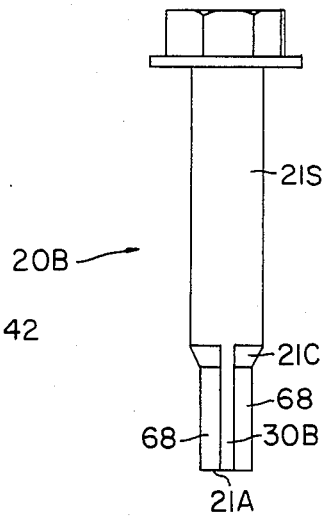
FIG. 4 is a side elevational view of the completed blank.

Lower end wall 21A (FIG. 4) of the wire 20 is circular in cross section before being forced into the lower die cavity 30B in lower die insert 48 and is cold worked to form the three longitudinally extending protrusions or ribs 30B, 32B, and 34B on the blank 20B which extend vertically from the end wall 21*a* (FIG. 4) of the blank to upper ends 21C defining the location at which the die cavity 30B stopped cold working the wire. These ends 21C may be tapered transitional surfaces or a flat shoulder between the upper shank and the lower lead-in section on the blank 20B. Between each of the protrusions 30B, 32B and 34B on the blank 20B is a reduced diameter arcuate surface 68 which extends vertically from the lower end wall 21A of the blank to upper end 21C (FIG. 4) which is the location of the upper end 48A of the die insert 48. As best seen in FIG. 3, the curvature of the reduced diameter surfaces 68 on the blank 20B matches the curvature of the die arcuate wall sections 46 which form the same and these arcuate surfaces 68 define a circle which is smaller in diameter than the diameter of the upper cylindrical shank 21S (FIG. 4) of the blank which remains at the nominal wire diameter. By way of example for a number 12 screw, the wire radius at the shank 21S of the blank may be about 0.082 inch and each of the protrusions 30B, 32B and 34B may have a radius of about 0.094 inch or about 0.012 inch greater in radius than that of the cylindrical shank. The circumferential extent of the protrusions may be varied but herein is about 0.020 each for a total of about 0.060 inch for three protrusions for a number 12 screw. The number of protrusions as well as their length, radius, and circumferential extent may be varied considerably from that described herein and still fall within the purview of the present invention.

It will be seen from the foregoing that the three arcuate wall sections 46 of the die insert 48 define a substantially circular cross-section cavity with three slots 45 and that the wire metal is forced to move into and fill the die slots 45 leaving a reduced cross section for the wire due to the metal displaced therefrom into the die slots. The preferred protrusions 30B, 32B and 34B extend the full height of the lead-in section between end wall 21A and upper ends 21C thereof and it is preferred that there is no taper on the blank's lower end prior to forming the screw by conventional thread rolling techniques. It is also preferred that radially outermost surface of the protrusions be arcuate and co-axially formed with the longitudinal axis of the wire and blank formed from the wire. As will be explained, in the thread rolling operation, the metal from the protrusions 30B, 32B and 34 is pushed circumferentially and moved toward the lesser diameter arcuate surfaces 68 with material at the protrusions forming the higher (greater radius) lobes 30, 32 and 34 (FIG. 4) which will cut and form the thread in the workpiece. Also, as will be explained in greater detail in connection with FIG. 5, the threading forming operation forces the distal end of the blank 20B to make fully formed threads having a sharp cutting crest even at the smallest diameter, first thread for the screw.

Wire stock of the requisite diameter is fed from a supply reel and is cut by a knife to the predetermined length of wire 20W. The wire is placed in axial alignment with the cavitiesy 30A and 30B of die insert 44, the first cavity 30A being of slightly larger diameter than the wire, and the ram is operated with the above-described result. The wire-stock feeding mechanism, cutting knife and wire piece transfer mechanism are all conventional in screw-forming machines and, therefore, need not be further discussed herein. As the ram advances, the wire 20W is expanded slightly to fill the upper cavity.

After the shaping of lower end of the blank 20B is completed, the ram 52 is retracted and, with the wire still in the die, a heading ram 56 (FIG. 2) is forced against the trailing wire end to shape that end into the desired configuration of screw head 22, for instance, into the polygonal shape shown. The heading ram is then retracted, whereupon the ejector rod 54 is axially advanced to eject the finished blank 20B, best shown in FIG. 3, from the die assembly 42.

Figure 5:
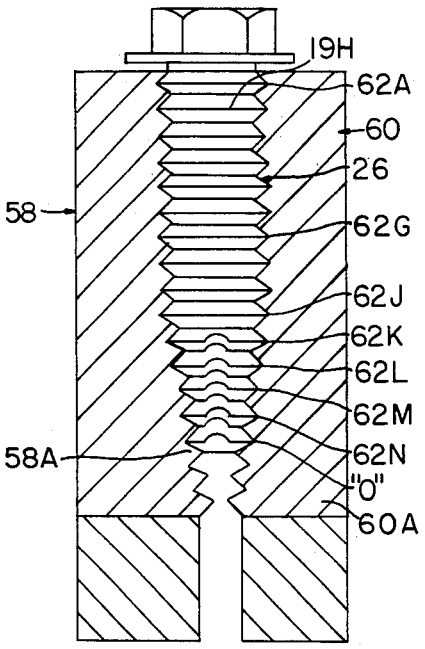
FIG. 5 is a fragmentary sectional view showing the blank of FIG. 4 being roll-threaded and tapered by contoured roll-threading dies.

Referring to FIG. 5, blank 20B is placed between conventional contoured roll-threading dies 58, 60 which are adapted to undergo relative parallel movement at right angles to the plane of FIG. 5, to concurrently form a screw thread and to taper the distal end 28 of the blank. More specifically, rather using flat dies or dies with special rolling threads such as used in U.S. Pat. No. 4,235,149, the roll threading dies 58 and 60 have tapered thread sections 58A and 58B for tapering the distal end of the blank and for forming the sharp crest of threads therein. Projections 62A-62J of die 58 are equally spaced from their corresponding projections 64A-64J on the die 60 to form sharply crested turns on the holding portion 26 of the screw shank 20B without tapering of that portion. The projections 64A-64J form sharply pointed maximum crests of equal diameter and form constant root diameters for the holding threads 19H that are circular in cross section. The formed, holding threads 19H are helical.

Figure 8:
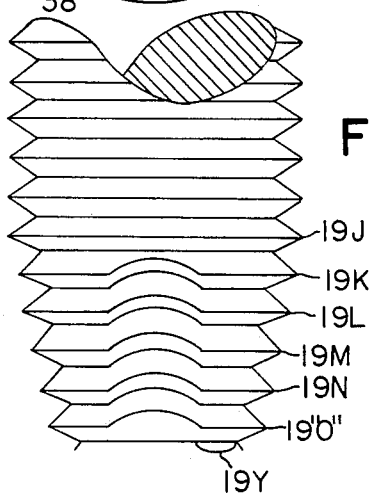
FIG. 8 is an enlarged elevational view of the lower end of the screw shown in FIG. 6.

The tapered sections 58A and 60A of the roll threading dies 58 and 60 have projections 62K-"O" to roll and form metal into the lead-in threads on the lead-in end of the blank 20B simultaneously with the formation of the holding threads 19H. Since the metal at the protrusions 30B, 32B and 34B extends radially outwardly of the metal at the surfaces 68, the metal at these protrusion locations will be formed into sharp-crested lobes 30, 32 and 34 which have a trilobular shape in cross section substantially as shown in FIG. 7. The tapered thread sections of the dies force the metal in the axial direction toward the free end 21A of the blank during the roll to elongate the blank while tapering it from the substantially constant diameter defined by the surfaces 68(FIG. 4) on the distal lead-in portion of the blank. The surfaces 68 are rolled into the concave relief surfaces 36, 38 and 40 which are substantially reduced in radius from the greater radius for an adjacent lobe 30, 32 or 34. Herein, the five lead-in threads 19 "O"-19J (FIG. 8) are substantially fully formed and define substantially, continuous helical threads each having sharp crests 19X. The sharp crests 19X will do the cutting of the workpiece more efficiently and with less torque than the flattened and more dull second and third lead-in threads shown in U.S. Pat. Nos. 3,461,470 and 4,235,149. A slight cup 19Y of metal may be found at the distal end of the screw. This cup of metal is formed by metal that continues to roll forward when forming the first small diameter thread 19 "O". That is, projections 62 "O" push the metal at the tip downward as viewed in FIG. 5 to leave a little extra metal at the tip of the fastener in a cup shaped form herein called "the cup 19Y." The second thread 19B is slightly smaller in diameter than the third thread 19C, etc. The threads 19H of the holding section have no metal displaced toward the tip. However, the lead-in threads are unlike those threads formed from the frusto-conical blank ends of the prior art, see U.S. Pat. No. 3,461,470, wherein the crests of the die projections penetrate less into the metal progressively toward the smaller diameter end of the conical end of the blank to roll threads that are not fully formed in the lead-in section. The lead-in threads are also different from those disclosed in U.S. Pat. No. 4,235,149 in which the threads are not fully formed and have flats thereon rather than the sharp crests 19X which extend completely around each of the threads in the lead-in section.

As best shown in FIG. 7, each turn of the screw threads 19A, 19B and 19C has three lobes 30, 32 and 34 with the lobes spaced by the concave relief surfaces 36, 38 and 40. The lobes are formed from the work-hardened ribs 30B, 32B and 34B and they have sharp crests 19X to easily cold flow the material in the workpiece to form a screw thread therein. Even the very first turn 19A of the screw has a sharply crested lobe for initiating the female thread forming operation. In sharp contrast, prior art screws having trilobular leading threads had several wholly incompletely formed turns with flattened or dulled crests which require more driving torque. The tapered lead-in sections 58A and 60A assure that the lead-in section of the blank and the threads thereon are formed co-axially with the threads 19H on the holding section because the die threads 62N-62A are all centered on the axis and confine the metal therebetween. Thus the screw blanks are rolled with a substantially tapered and co-axial lead-in section which better centers the screw in the workpiece. In U.S. Pat. No. 3,461,470 the blank is tipped in the die to form the lead-in section so that the screw does not center as well. Whereas, as seen in FIG. 7 herein, each of the threads 19A, 19B and 19C are co-axially formed with the axis of the screw and constitute a helical lead-in centered on the screw axis to assist in a straight line drive for the screw into the workpiece.

Because the metal in the blank 20B is moved axially toward the tip 21A of the blank when rolling the lead-in section between the tapered die sections 58A and 60A, the finished screw has a longer length than it had as a blank prior to the thread forming. Also, the blank 20B tends to elongate about 0.010 to 0.015 inch longer than do the blanks used in U.S. Pat. No. 4,235,149 because of the metal that is displaced when forming the tapered shape in the die. This enables one to start with a slightly shorter blank.

As the screw is threaded into the pilot hole of a work piece in which a mating female thread is to be formed, the fully formed, sharp crested, work-hardened lobes 30, 32 and 34 in the initial turn 19A of the screw thread cold flow the material defining the pilot hole. Upon entrance into the workpiece of the first pair of threads 19A and 19B, the mating thread has been formed in the workpiece. As advancement of the screw continues, the next successive lobe of the distal end progressively enlarges the mating thread with the concave relief surfaces 32, 34 and 36, providing regions of relief into which the workpiece metal flows when into forming the workpiece thread; and this reduces the driving torque required to form the mating thread. As the lobes 32, 34 and 36 are formed of work-hardened material, they do not blunt and because each of the threads 19A-H is fully formed and sharp crested, the driving torque is further reduced.

When the holding portion 26 of the screw enters the pilot hole, its thread makes full contact around 360 degrees with the mating thread in the work piece and thus provides a maximum of holding between the screw and the work piece. The driving torque of the present invention is considerably reduced from that of conventional self-threading screws. Some companies do not even provide some types of screws such as 12/24 thread because they can not be readily driven whereas such screw sizes of the present invention can be readily driven. The screw of the present invention, because it is centered, drives in more straight than does some prior art screws which tend to cock to the workpiece when being driven. Further, the blanking of the wire is easier on the dies of the present invention than in others where the force required to form a conical end on the blank and to remove the blank results in a chipping of dies. The very thin longitudinal ribs are used to form the lobes rather than, as in the prior art, having large flats on a tapered end of a blank or a conical blank end with large amounts of metal to be displaced to form the lobes. Herein, taper sections on the roll forming dies are able to reform the lead-in section of the blank into a tapered, frusto-conical lead-in section with threads thereon from a non-tapered blank end.

In view of the above, it will be seen that the several objects of the invention are achieved and other advantageous results attained.

As various changes could be made in the above description without departing from the scope of the invention, it is intended that all matter contained in the above description shall be interpreted as illustrative and not in a limiting sense.

What is claimed is:

1. A method of manufacturing from a cylindrical piece of wire a thread forming screw having a head end and a constant diameter helical screw on a cylindrical shank, and a plurality of lead-in threads on a distal end with sharp crests and thread lobes and intermediate relief concave areas on the lead-in threads, said method comprising the steps of:

forcing a distal end of the cylindrical wire into a die having an inner cylindrical cavity portion and a plurality of longitudinally extending grooves in an inner section of the cylindrical cavity portion to form a reduced diameter cylindrical portion with a plurality of upstanding, longitudinally extending ribs on the distal end of the wire;

forming a head on the head end of the wire while leaving the shank and the reduced diameter cylindrical portion with the ribs thereon unworked;

rolling the shank between a first portion of thread forming dies to form the constant diameter helical screw on the cylindrical shank;

simultaneously tapering the cylindrical distal end by rolling it between tapered thread sections on the thread forming dies to taper the distal end and to form sharp crested threads with the metal at the ribs being formed into sharp crested lobes and with sharp crested concave relief areas being formed on the lead-in threads intermediate the lobes, and simultaneously lengthening the lead-in section while tapering the distal end of the wire.

2. A method in accordance with claim 1 including the step of forcing the distal wire end into three grooves of the same height throughout to form three upstanding longitudinally extending ribs of the same height.

3. A method in accordance with claim 1 in which the step of lengthening the lead-in section while tapering the same comprises pushing the metal at a tip of the screw into a cup shape projection at the tip of the screw.

* * * * *